US011136946B2

(12) United States Patent
Sumi et al.

(10) Patent No.: US 11,136,946 B2
(45) Date of Patent: Oct. 5, 2021

(54) EGR GAS DISTRIBUTOR

(71) Applicant: TOYOTA JIDOSHA KABUSHIKI KAISHA, Toyota (JP)

(72) Inventors: Norihiko Sumi, Miyoshi (JP); Noriyasu Mishima, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/905,971

(22) Filed: Jun. 19, 2020

(65) Prior Publication Data

US 2020/0408174 A1 Dec. 31, 2020

(30) Foreign Application Priority Data

Jun. 26, 2019 (JP) ..... JP2019-118465

(51) Int. Cl.

| | |
|---|---|
| ***F02M 26/21*** | (2016.01) |
| ***F02M 26/42*** | (2016.01) |
| ***F02M 35/112*** | (2006.01) |
| ***F02M 35/10*** | (2006.01) |
| ***F02M 26/41*** | (2016.01) |
| ***F02M 26/20*** | (2016.01) |

(52) U.S. Cl.

CPC ..... *F02M 26/21* (2016.02); *F02M 26/20* (2016.02); *F02M 26/41* (2016.02); *F02M 26/42* (2016.02); *F02M 35/10222* (2013.01); *F02M 35/112* (2013.01)

(58) Field of Classification Search

CPC ..... F02M 26/21; F02M 26/41; F02M 26/20; F02M 35/1022; F02M 35/112

USPC ..... 123/568.18

See application file for complete search history.

(56) References Cited

U.S. PATENT DOCUMENTS

| | | | | |
|---|---|---|---|---|
| 2017/0122233 | A1* | 5/2017 | Didonato | F02M 26/53 |
| 2017/0226968 | A1* | 8/2017 | Nakamura | F02M 26/20 |
| 2018/0045150 | A1 | 2/2018 | Ito | |

FOREIGN PATENT DOCUMENTS

| | | | | |
|---|---|---|---|---|
| JP | 2012225170 A | * | 11/2012 | |
| JP | 2016089687 A | * | 5/2016 | F02M 35/10222 |
| JP | 2018-25123 A | | 2/2018 | |

OTHER PUBLICATIONS

JP2012225170A (Sumi et al.) (Nov. 15, 2012) [machine translation] retrieved from Espacenet on Dec. 1, 2020. (Year: 2012).*

* cited by examiner

*Primary Examiner* — Mahmoud Gimie
(74) *Attorney, Agent, or Firm* — Oblon, McClelland, Maier & Neustadt, L.L.P.

(57) ABSTRACT

An EGR gas distributor includes an inflow portion into which EGR gas that has passed through an EGR valve flows, a first EGR port connected to a section of the intake manifold in which intake air introduced into the first cylinder flows, a second EGR port connected to a section of the intake manifold in which intake air introduced into the second cylinder flows, a first gas passage that connects the inflow portion and the first EGR port to each other, and a second gas passage that connects the first gas passage and the second EGR port to each other. A shortest path between the first EGR port and the second EGR port is longer than both of a shortest path between the inflow portion and the first EGR port and a shortest path between the inflow portion and the second EGR port.

6 Claims, 4 Drawing Sheets

EGR GAS DISTRIBUTOR

BACKGROUND

1. Field

The following description relates to an exhaust gas recirculation (EGR) gas distributor that introduces EGR gas that has passed through an EGR valve into an intake manifold.

2. Description of Related Art

Japanese Laid-Open Patent Publication No. 2018-25123 discloses one example of an EGR gas distributor that is employed in an internal combustion engine having multiple cylinders arranged in series. The EGR gas distributor includes an inflow portion in which EGR gas that has passed through an EGR valve flows. A first branch passage and a second branch passage are connected to the inflow portion. The first branch passage branches into a first gas passage and a second gas passage on the downstream side. The second branch passage branches into a third gas passage and a fourth gas passage on the downstream side. EGR gas that has flowed through the first gas passage is introduced into a first cylinder, and EGR gas that has flowed through the second gas passage is introduced into a second cylinder. EGR gas that has flowed through the third gas passage is introduced into a third cylinder, and EGR gas that has flowed through the fourth gas passage is introduced into a fourth cylinder.

In the above-described internal combustion engine, the four cylinders are arranged in a cylinder arrangement direction in order of the first cylinder, the second cylinder, the third cylinder, and the fourth cylinder. The first cylinder and the second cylinder, which are adjacent to each other in the cylinder arrangement direction, are also temporally adjacent to each other in terms of points in time at which the intake strokes start.

A case will now be considered in which, of the first cylinder and the second cylinder, the intake stroke of the second cylinder starts before the intake stroke of the first cylinder. In this case, the intake stroke of the first cylinder starts after or immediately before the end of the intake stroke of the second cylinder. Immediately after the end of the intake stroke of the second cylinder, blowback of intake air due to closing of the intake valve may cause the intake air to flow into the second gas passage from the intake manifold. In such a case, the intake air that has flowed into the second passage may flow into the first gas passage during the intake stroke of the first cylinder, and that intake air may flow through the first gas passage and be introduced into the first cylinder together with EGR gas. In this case, the amount of the EGR gas introduced into the first cylinder is less than the amount of the EGR gas introduced into the second cylinder. That is, of the first and second cylinders, the amount of the EGR gas introduced into the cylinder in which the intake stroke is started later becomes less than the amount of the EGR gas introduced into the cylinder in which the intake stroke starts earlier. Therefore, there is room for improvement in suppression of variation in amounts of EGR gas introduced into two cylinders that are temporally adjacent to each other in terms of starting points in time of intake strokes.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an EGR gas distributor is configured to be connected to an intake manifold of an internal combustion engine. The internal combustion engine to which the EGR gas distributor is connected has four cylinders. The four cylinders are arranged in order of a first cylinder, a second cylinder, a third cylinder, and a fourth cylinder in a cylinder arrangement direction. A starting point in time of an intake stroke of the first cylinder and a starting point in time of an intake stroke of the second cylinder are temporally adjacent to each other. The EGR gas distributor includes an inflow portion into which EGR gas that has passed through an EGR valve flows, a first EGR port connected to a section of the intake manifold in which intake air introduced into the first cylinder flows, a second EGR port connected to a section of the intake manifold in which intake air introduced into the second cylinder flows, a first gas passage that connects the inflow portion and the first EGR port to each other, and a second gas passage that connects the first gas passage and the second EGR port to each other. A shortest path between the first EGR port and the second EGR port is longer than both of a shortest path between the inflow portion and the first EGR port and a shortest path between the inflow portion and the second EGR port.

A case will now be considered in which intake strokes start in order of the first cylinder, the third cylinder, the fourth cylinder, and the second cylinder. In this case, when the intake stroke of the second cylinder ends, blowback of intake air due to closing of the intake valve of the second cylinder may cause the intake air to flow into the EGR gas distributor from the intake manifold through the second EGR port. If the shortest path between the first EGR port and the second EGR port is relatively short, the intake air that has flowed into the EGR gas distributor through the second EGR port may reach the first EGR port together with EGR gas, and that intake air may flow into the intake manifold from the first EGR port. In this case, the amount of the EGR gas introduced into the first cylinder is less than the amount of the EGR gas introduced into the second cylinder.

A case will now be considered in which intake strokes start in order of the first cylinder, the second cylinder, the fourth cylinder, and the third cylinder. In this case, when the intake stroke of the first cylinder ends, intake air may flow into the EGR gas distributor through the first EGR port. If the shortest path between the first EGR port and the second EGR port is relatively short, the intake air that has flowed into the EGR gas distributor through the first EGR port may flow into the intake manifold from the second EGR port together with the EGR gas. In this case, the amount of the EGR gas introduced into the second cylinder is less than the amount of the EGR gas introduced into the first cylinder.

As such, in the above-described configuration, the shortest path between the first EGR port and the second EGR port is longer than both of the shortest path between the inflow portion and the first EGR port and the shortest path between the inflow portion and the second EGR port. One of the first cylinder and the second cylinder in which the intake stroke starts first is referred to as a preceding cylinder, and the one in which the intake stroke starts later is referred to as a following cylinder. During the period in which the intake stroke of the following cylinder ends, the intake air that has flowed into the EGR gas distributor when the intake stroke of the preceding cylinder ends is unlikely to reach the EGR port corresponding to the following cylinder. This suppresses reduction in the amount of the EGR gas introduced into the following cylinder. Thus, for the first cylinder and the second cylinder, which are temporally adjacent to each other in terms of the starting points in time of intake strokes, the above-described configuration suppresses the deviation between the amount of the EGR gas introduced into the first cylinder and the amount of the EGR gas introduced into the second cylinder.

In an aspect of the above-described EGR gas distributor, a bent portion that changes a flowing direction of gas is provided in each of the first gas passage and the second gas passage.

The shortest path between the first EGR port and the second EGR port includes the second gas passage and a section of the first gas passage from the connection site connected to the second gas passage to the first EGR port. Thus, since the bent portion is provided in each of the first gas passage and the second gas passage in the above-described configuration, the flow resistance of the shortest path between the first EGR port and the second EGR port is increased. This reduces the flow velocity of the intake air flowing through the shortest path from the EGR port corresponding to the preceding cylinder during the intake stroke of the following cylinder. As a result, the intake air is unlikely to reach the EGR port corresponding to the following cylinder during the intake stroke of the following cylinder. This further effectively suppresses the deviation between the amount of the EGR gas introduced into the first cylinder and the amount of the EGR gas introduced into the second cylinder.

In an aspect of the above-described EGR gas distributor, a constriction is provided in the shortest path between the first EGR port and the second EGR port.

In the above-described configuration, since the constriction is provided in the path between the first EGR port and the second EGR port, the flow resistance is greater than in a case in which such a constriction is not provided in the path. This reduces the flow velocity of the intake air flowing through the path from the EGR port corresponding to the preceding cylinder during the intake stroke of the following cylinder. As a result, the intake air is unlikely to reach the EGR port corresponding to the following cylinder during the intake stroke of the following cylinder. This further effectively suppresses the deviation between the amount of the EGR gas introduced into the first cylinder and the amount of the EGR gas introduced into the second cylinder.

In another aspect, the above-described EGR gas distributor includes a third EGR port connected to a section of the intake manifold in which intake air introduced into the third cylinder flows, a fourth EGR port connected to a section of the intake manifold in which intake air introduced into the fourth cylinder flows, a fourth gas passage that connects the inflow portion and the fourth EGR port to each other, and a third gas passage that connects the fourth gas passage and the third EGR port to each other. A direction in which the first to fourth EGR ports are arranged is referred to as a port arrangement direction. The first to fourth EGR ports are arranged in the port arrangement direction in order of the first EGR port, the second EGR port, the third EGR port, and the fourth EGR port. The inflow portion is disposed between the second EGR port and the third EGR port in the port arrangement direction. A shortest path between the third EGR port and the fourth EGR port is longer than both of a shortest path between the inflow portion and the third EGR port and a shortest path between the inflow portion and the fourth EGR port.

In the above-described configuration, the shortest path between the third EGR port and the fourth EGR port is longer than both of the shortest path between the inflow portion and the third EGR port and the shortest path between the inflow portion and the fourth EGR port. One of the third cylinder and the fourth cylinder in which the intake stroke starts first is referred to as a preceding cylinder, and the one in which the intake stroke starts later is referred to as a following cylinder. During the period in which the intake stroke of the following cylinder ends, the intake air that has flowed into the EGR gas distributor via the EGR port when the intake stroke of the preceding cylinder ends is unlikely to reach the EGR port corresponding to the following cylinder. This suppresses reduction in the amount of the EGR gas introduced into the following cylinder. Thus, for the third cylinder and the fourth cylinder, which are temporally adjacent to each other in terms of the starting points in time of intake strokes, the above-described configuration suppresses the deviation between the amount of the EGR gas introduced into the third cylinder and the amount of the EGR gas introduced into the fourth cylinder.

In an aspect of the above-described EGR gas distributor, a connection site between the first gas passage and the second gas passage is located between the second EGR port and the inflow portion in the port arrangement direction.

In this configuration, the shortest path between the first EGR port and the second EGR port includes the second gas passage and a section of the first gas passage between the connection site and the first EGR port. In the above-described configuration, the connection site is located between the second EGR port and the inflow portion in the port arrangement direction. Thus, the second gas passage and the section of the first gas passage between the connection site and the first EGR port are longer than those in a case in which the connection site is located between the first EGR port and the second EGR port in the port arrangement direction. This lengthens the shortest path between the first EGR port and the second EGR port.

In an aspect of the above-described EGR gas distributor, a connection site between the third gas passage and the fourth gas passage is located between the third EGR port and the inflow portion in the port arrangement direction.

In this configuration, the shortest path between the third EGR port and the fourth EGR port includes the third gas passage and a section of the fourth gas passage between the connection site and the fourth EGR port. In the above-described configuration, the connection site is located between the third EGR port and the inflow portion in the port arrangement direction. Thus, the third gas passage and the section of the fourth gas passage between the connection site and the fourth EGR port are longer than those in a case in which the connection site is located between the third EGR port and the fourth EGR port in the port arrangement direction. This lengthens the shortest path between the third EGR port and the fourth EGR port.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An EGR gas distributor 23 according to an embodiment will now be described with reference to FIGS. 1 to 7.

Figure 1:
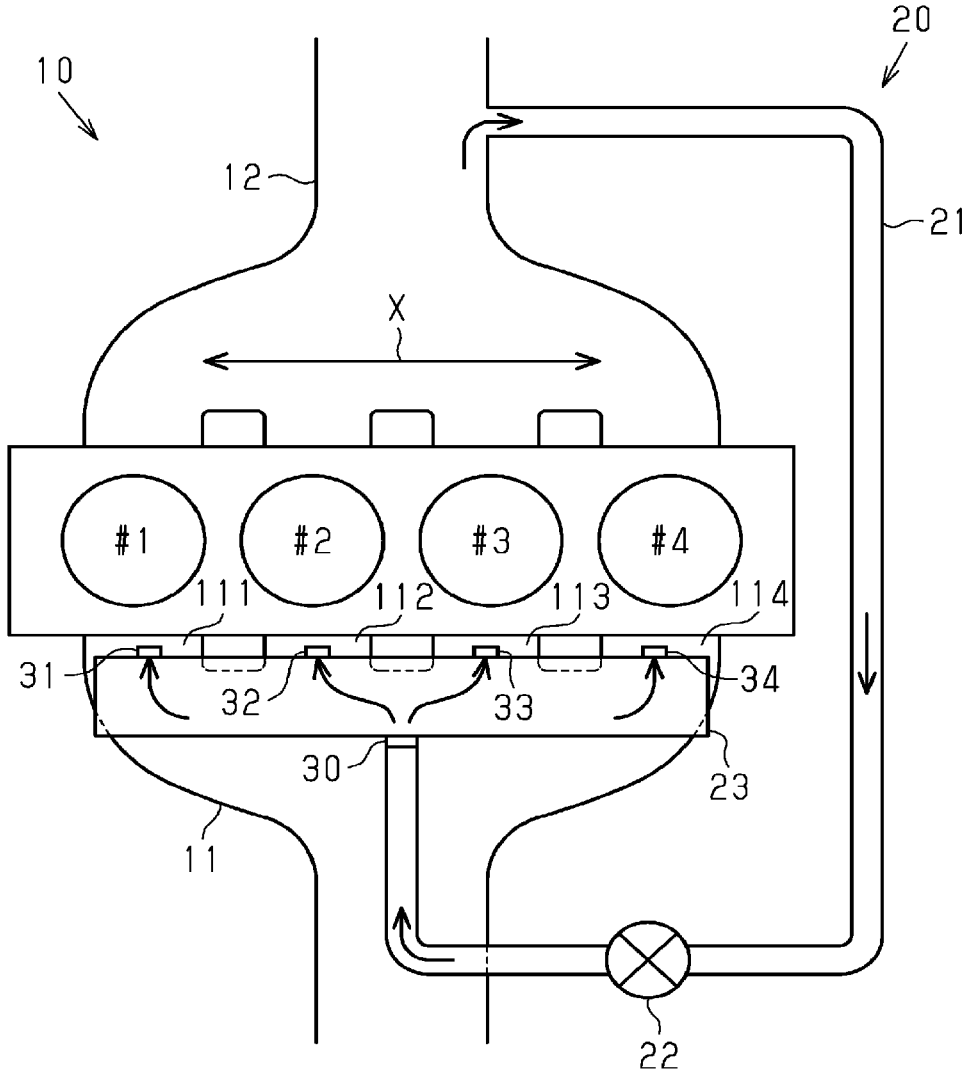
FIG. 1 is a schematic diagram showing an internal combustion engine equipped with an EGR gas distributor according to an embodiment.

FIG. 1 illustrates an internal combustion engine 10 that is equipped with the EGR gas distributor 23 of the present embodiment. The internal combustion engine 10 is an inline four-cylinder engine. The internal combustion engine 10 includes four cylinders #1, #2, #3, and #4, which are arranged in a cylinder arrangement direction X in order of the first cylinder #1, the second cylinder #2, the third cylinder #3, and the fourth cylinder #4. Air-fuel mixture containing fuel and intake air introduced through an intake manifold and is burned in each of the cylinders #1 to #4. Exhaust gas generated by combustion of the air-fuel mixture in each of the cylinders #1 to #4 is discharged to an exhaust pipe 12.

In the internal combustion engine 10, intake strokes start in order of the first cylinder #1, the third cylinder #3, the fourth cylinder #4, and the second cylinder #2. That is, a point in time at which the intake stroke of the first cylinder #1 starts and a point in time at which the intake stroke of the second cylinder #2 starts are temporally adjacent to each other. Also, a point in time at which the intake stroke of the third cylinder #3 starts and a point in time at which the intake stroke of the fourth cylinder #4 starts are temporally adjacent to each other.

An intake manifold 11 includes intake branch pipes 111, 112, 113, and 114, the number of which is the same as the number of cylinders of the internal combustion engine 10. Among the intake branch pipes 111 to 114, the intake air that has flowed through the intake branch pipe 111 is introduced into the first cylinder #1. The intake air that has flowed through the intake branch pipe 112 is introduced into the second cylinder #2. The intake air that has flowed through the intake branch pipe 113 is introduced into the third cylinder #3. The intake air that has flowed through the intake branch pipe 114 is introduced into the fourth cylinder #4. That is, the intake branch pipe 111 corresponds to a section of the intake manifold 11 through which the intake air introduced into the first cylinder #1 flows. The intake branch pipe 112 corresponds to a section of the intake manifold 11 through which the intake air introduced into the second cylinder #2 flows. The intake branch pipe 113 corresponds to a section of the intake manifold 11 through which the intake air introduced into the third cylinder #3 flows. The intake branch pipe 114 corresponds to a section of the intake manifold 11 through which the intake air introduced into the fourth cylinder #4 flows.

The internal combustion engine 10 includes an EGR device 20, which returns exhaust gas flowing through the exhaust pipe 12 to the intake manifold 11 as EGR gas. EGR stands for exhaust gas recirculation. The solid arrows in FIG. 1 represent the flow of EGR gas that is returned to the intake manifold 11 by the EGR device 20.

The EGR device 20 includes an EGR passage 21 connected to the exhaust pipe 12 and the EGR gas distributor 23, which connects the EGR passage 21 and the intake manifold 11 to each other. An EGR valve 22 is provided in the middle of the EGR passage 21. The EGR valve 22 regulates the amount of EGR gas that is returned to the intake manifold 11 through the EGR device 20.

The EGR gas distributor 23 includes an inflow portion 30 to which the EGR passage 21 is connected and EGR ports 31, 32, 33, and 34, the number of which is the same as the number of the cylinders of the internal combustion engine 10. That is, EGR gas that has flowed through the EGR valve 22 flows into the EGR gas distributor 23 through the inflow portion 30. Among the EGR ports 31 to 34, the first EGR port 31 is connected to the intake branch pipe 111 of the intake manifold 11. The second EGR port 32 is connected to the intake branch pipe 112 of the intake manifold 11. The third EGR port 33 is connected to the intake branch pipe 113 of the intake manifold 11. The fourth EGR port 34 is connected to the intake branch pipe 114 of the intake manifold 11. Thus, EGR gas that has flowed out of the first EGR port 31 flows through the intake branch pipe 111 and is introduced into the cylinder #1. EGR gas that has flowed out of the second EGR port 32 flows through the intake branch pipe 112 and is introduced into the cylinder #2. EGR gas that has flowed out of the third EGR port 33 flows through the intake branch pipe 113 and is introduced into the cylinder #3. EGR gas that has flowed out of the fourth EGR port 34 flows through the intake branch pipe 114 and is introduced into the cylinder #4.

Figure 2:
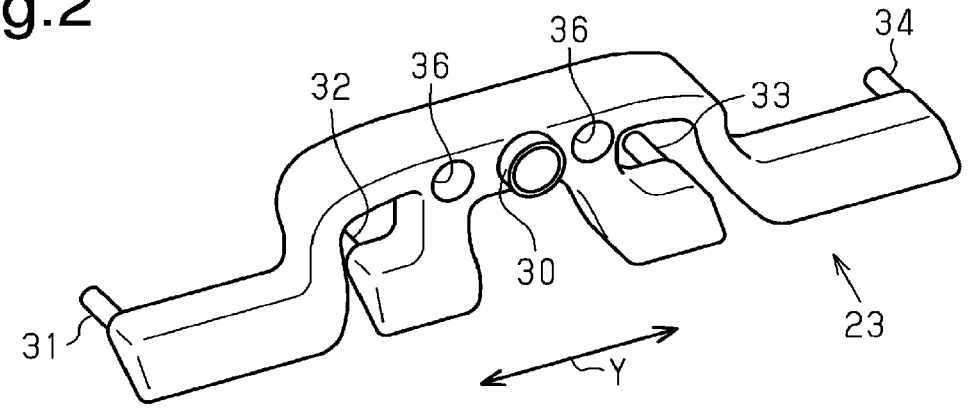
FIG. 2 is a perspective view showing the EGR gas distributor.

The direction in which the first to fourth EGR ports 31 to 34 are arranged is referred to as a port arrangement direction Y. As shown in FIG. 2, the first to fourth EGR ports 31 to 34 are arranged in the port arrangement direction Y in order of the first EGR port 31, the second EGR port 32, the third EGR port 33, and the fourth EGR port 34. The inflow portion 30 is located between the second EGR port 32 and the third EGR port 33 in the port arrangement direction Y.

Figure 3:
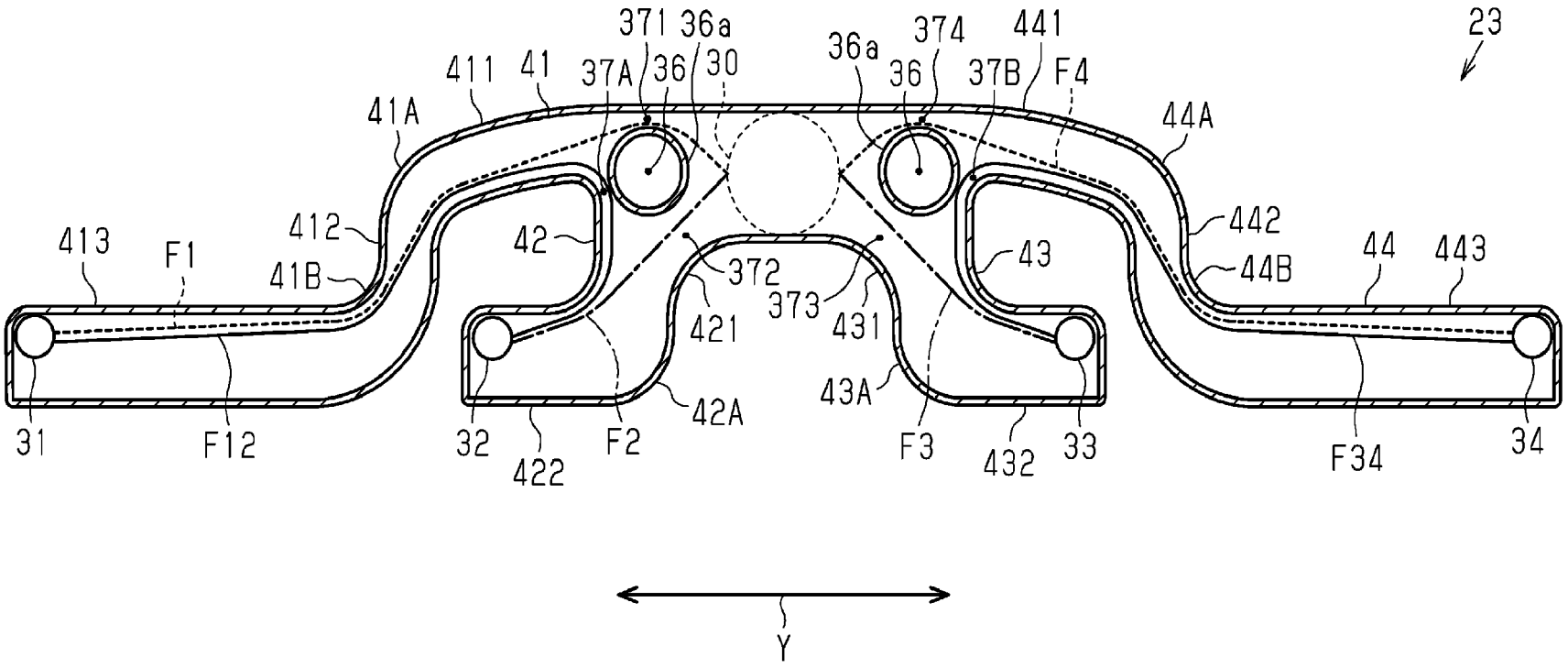
FIG. 3 is a cross-sectional view of the EGR gas distributor.

As shown in FIGS. 2 and 3, the EGR gas distributor 23 includes a first gas passage 41 that connects the inflow portion 30 and the first EGR port 31 to each other and a fourth gas passage 44 that connects the inflow portion 30 and the fourth gas passage 44 to each other. The first gas passage 41 includes multiple bent portions 41A, 41B, which change the flowing direction of gas flowing in the first gas passage 41. That is, the first gas passage 41 includes a first passageway 411 extending from the inflow portion 30 and a second passageway 412 extending in a direction different from that of the first passageway 411. The first bent portion 41A is disposed between a distal end of the first passageway 411 and a proximal end of the second passageway 412. The first gas passage 41 includes a third passageway 413 connected to the first EGR port 31. The direction in which the third passageway 413 extends is different from the direction in which the second passageway 412 extends. The second bent portion 41B is disposed between a distal end of the second passageway 412 and a proximal end of the third passageway 413.

The fourth gas passage 44 includes multiple bent portions 44A, 44B. That is, the fourth gas passage 44 includes an eighth passageway 441 extending from the inflow portion 30 and a ninth passageway 442 extending in a direction different from that of the eighth passageway 441. The fifth bent portion 44A is disposed between a distal end of the eighth passageway 441 and a proximal end of the ninth passageway 442. The fourth gas passage 44 includes a tenth passageway 443 connected to the fourth EGR port 34. The direction in which the tenth passageway 443 extends is different from the direction in which the ninth passageway 442 extends. The sixth bent portion 44B is disposed between a distal end of the ninth passageway 442 and a proximal end of the tenth passageway 443.

The EGR gas distributor 23 includes a second gas passage 42 that connects the first gas passage 41 and the second EGR port 32 to each other. Specifically, the second gas passage 42 is connected to the first passageway 411 of the first gas passage 41. The connection site between the first gas passage 41 and the second gas passage 42 is located between the second EGR port 32 and the inflow portion 30 in the port arrangement direction Y. The second gas passage 42 includes a fourth passageway 421 extending from the connection site connected to the first gas passage 41 and a fifth passageway 422 connected to the second EGR port 32. The direction in which the fourth passageway 421 extends is different from both of the direction in which the fifth passageway 422 extends and the direction in which the first passageway 411 of the first gas passage 41 extends. A third bent portion 42A is disposed between a distal end of the fourth passageway 421 and a proximal end of the fifth passageway 422.

The EGR gas distributor 23 includes a third gas passage 43 that connects the fourth gas passage 44 and the third EGR port 33 to each other. Specifically, the third gas passage 43 is connected to the eighth passageway 441 of the fourth gas passage 44. The connection site between the fourth gas passage 44 and the third gas passage 43 is located between the third EGR port 33 and the inflow portion 30 in the port arrangement direction Y. The third gas passage 43 includes a sixth passageway 431 extending from the connection site connected to the fourth gas passage 44 and a seventh passageway 432 connected to the third EGR port 33. The direction in which the sixth passageway 431 extends is different from both of the direction in which the seventh passageway 432 extends and the direction in which the eighth passageway 441 of the fourth gas passage 44 extends. A fourth bent portion 43A is disposed between a distal end of the sixth passageway 431 and a proximal end of the seventh passageway 432.

The EGR gas distributor 23 includes two accommodating portions 36 located on the opposite sides of the inflow portion 30 in the port arrangement direction Y. The accommodating portions 36 are separated from passages through which EGR gas flows in the EGR gas distributor 23. Each accommodating portion 36 communicates with the outside of the EGR gas distributor 23, while being separated by a partition wall 36*a* from the passage through which EGR gas flows. Each accommodating portion 36 accommodates a component such as a part of a bolt or nut that is used to attach the EGR gas distributor 23 to a component arranged close to the EGR gas distributor 23. The component to which the EGR gas distributor 23 is attached may be one of the pipes included in the EGR passage 21, which is, for example, a pipe that connects the EGR valve 22 and the EGR gas distributor 23 to each other. The component may also be a component of the internal combustion engine 10 such as a cylinder block. The accommodating portion 36 may be either a through-hole or a recess as long as it is separated from passages through which EGR gas flows.

In the present embodiment, the accommodating portions 36 are located in respective vicinities of the connection site between the first gas passage 41 and the second gas passage 42 and the connection site between the fourth gas passage 44 and the third gas passage 43.

When the intake stroke of the second cylinder ends, blowback of intake air occurs in the intake branch pipe 112 due to closing of the intake valve corresponding to the second cylinder #2. As a result, the intake air may flow into the EGR gas distributor 23 from the intake branch pipe 112 through the second EGR port 32. In such a case, during the intake stroke of the first cylinder #1, the intake air that has flowed into the EGR gas distributor 23 through the second EGR port 32 may flow into the first gas passage 41 after flowing backward in the second gas passage 42 and may flow toward the first EGR port 31 through the first gas passage 41. At this time, if the flow path from the second EGR port 32 to the first EGR port 31 through the interior of the EGR gas distributor 23 is relatively short, the intake air may flow out to the intake branch pipe 111 from the first EGR port 31 and may be introduced into the first cylinder #1 during the intake stroke of the first cylinder #1.

Figure 4:
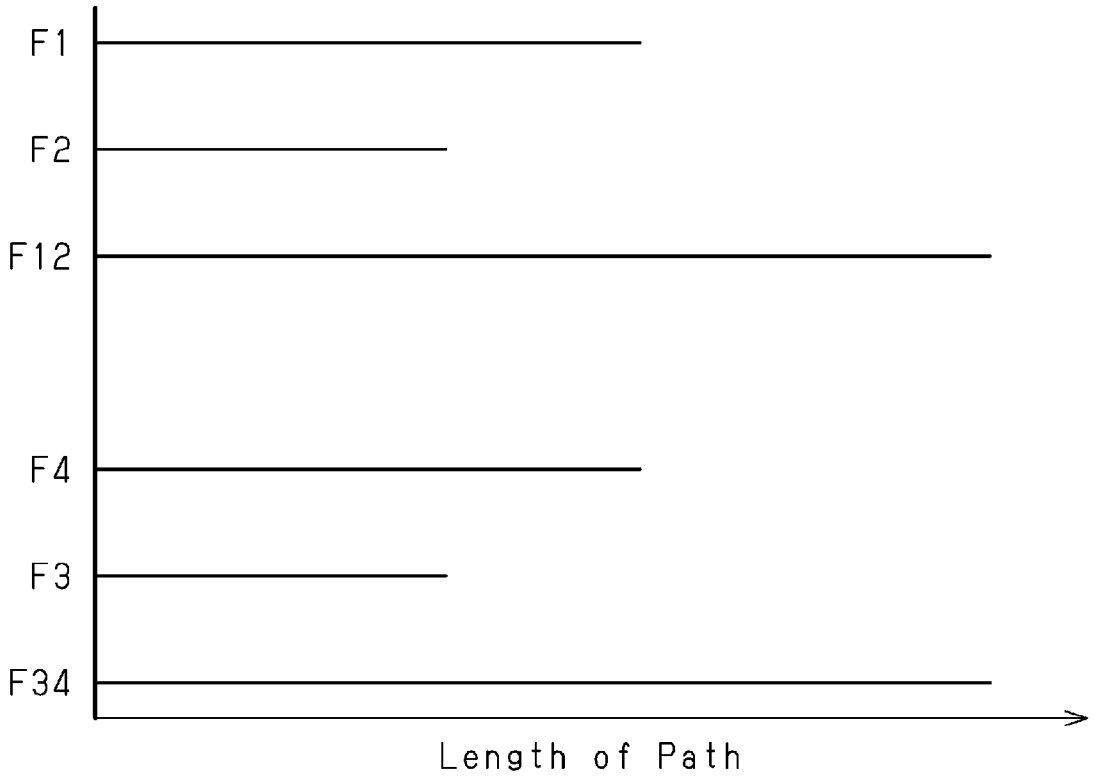
FIG. 4 is a diagram showing the relationship between a shortest path between a first EGR port and a second EGR port, a shortest path between an inflow portion and the first EGR port, a shortest path between the inflow portion and the second EGR port, a shortest path between a third EGR port and a fourth EGR port, a shortest path between the inflow portion and the third EGR port, and a shortest path between the inflow portion and the fourth EGR port.

Thus, the present embodiment is configured such that the lengths of the first gas passage 41 and the second gas passage 42, and the position of a first connection site, which is the connection site between the first gas passage 41 and the second gas passage 42, meet the condition shown in FIG. 4. That is, a backflow path F12 is longer than both of a first path F1 and a second path F2. The first path F1 is the shortest path of a gas flow from the inflow portion 30 to the first EGR port 31. The second path F2 is the shortest path of a gas flow from the inflow portion 30 to the second EGR port 32. The backflow path F12 is the shortest path between the first EGR port 31 and the second EGR port 32. Specifically, as indicated by the broken line in FIG. 3, the first path F1 is a path in the first gas passage 41. As indicated by the long dashed short dashed line in FIG. 3, the second path F2 extends over a section in the first gas passage 41 from the connection site connected to the inflow portion 30 to the first connection site, and the interior of the second gas passage 42. As indicated by the solid line in FIG. 3, the backflow path F12 extends over the interior of the second gas passage 42 and the interior of a section of the first gas passage 41 from the first connection site to the first EGR port 31.

As shown in FIG. 3, the first path F1, the second path F2, and the backflow path F12 each pass the vicinity of the accommodating portion 36. That is, the first path F1 includes a first constriction 371 in the vicinity of the accommodating portion 36. The first constriction 371 has a smaller cross-sectional area than the remainder of the first path F1. The second path F2 includes a second constriction 372 in the vicinity of the accommodating portion 36. The second constriction 372 has a smaller cross-sectional area than the remainder of the second path F2. The backflow path F12 includes a first backflow path constriction 37A in the vicinity of the accommodating portion 36. The first backflow path constriction 37A has a smaller cross-sectional area than the remainder of the backflow path F12. The cross-sectional area of the first backflow path constriction 37A is the smallest among the constrictions 371, 372, and 37A.

When the intake stroke of the third cylinder #3 ends, blowback of intake air occurs in the intake branch pipe 113 due to closing of the intake valve corresponding to the third cylinder #3. As a result, the intake air may flow into the EGR gas distributor 23 through the third EGR port 33 from the intake branch pipe 113. In such a case, during the intake stroke of the fourth cylinder #4, the intake air that has flowed into the EGR gas distributor 23 through the third EGR port 33 may flow into the fourth gas passage 44 after flowing backward in the third gas passage 43 and may flow toward the fourth EGR port 34 toward the fourth gas passage 44. At this time, if the flow path from the third EGR port 33 to the fourth EGR port 34 through the interior of the EGR gas distributor 23 is relatively short, the intake air may flow out to the intake branch pipe 114 from the fourth EGR port 34 and may be introduced into the fourth cylinder #4 during the intake stroke of the fourth cylinder #4.

Thus, the present embodiment is configured such that the lengths of the third gas passage 43 and the fourth gas passage 44, and the position of a second connection site, which is the connection site between the third gas passage 43 and the fourth gas passage 44, meet the condition shown in FIG. 4. That is, a backflow path F34 is longer than both of a third path F3 and a fourth path F4. The fourth path F4 is the shortest path of a gas flow from the inflow portion 30 to the fourth EGR port 34. The third path F3 is the shortest path of a gas flow from the inflow portion 30 to the third EGR port 33. The backflow path F34 is the shortest path between the third EGR port 33 and the fourth EGR port 34. Specifically, as indicated by the broken line in FIG. 3, the fourth path F4 is a path in the fourth gas passage 44. As indicated by the long dashed short dashed line in FIG. 3, the third path F3 extends over a section in the fourth gas passage 44 from the connection site connected to the inflow portion 30 to the second connection site, and the interior of the third gas passage 43. As indicated by the solid line in FIG. 3, the backflow path F34 extends over the interior of the third gas passage 43 and the interior of a section of the fourth gas passage 44 from the second connection site to the fourth EGR port 34.

As shown in FIG. 3, the third path F3, the fourth path F4, and the backflow path F34 each pass the vicinity of the accommodating portion 36. That is, the third path F3 includes a third constriction 373 in the vicinity of the accommodating portion 36. The third constriction 373 has a smaller cross-sectional area than the remainder of the third path F3. The fourth path F4 includes a fourth constriction 374 in the vicinity of the accommodating portion 36. The fourth constriction 374 has a smaller cross-sectional area than the remainder of the fourth path F4. The backflow path F34 includes a second backflow path constriction 37B in the vicinity of the accommodating portion 36. The second backflow path constriction 37B has a smaller cross-sectional area than the remainder of the backflow path F34. The cross-sectional area of the second backflow path constriction 37B is the smallest among the constrictions 373, 374, and 37B.

In the present embodiment, the length of the first path F1 from the inflow portion 30 to the first EGR port 31 is equal to the length of the fourth path F4 from the inflow portion 30 to the fourth EGR port 34 as shown in FIG. 4. The length of the second path F2 from the inflow portion 30 to the second EGR port 32 is equal to the length of the third path F3 from the inflow portion 30 to the third EGR port 33. The length of the backflow path F12, which connects the fourth EGR port 34 and the second EGR port 32 to each other, is equal to the length of the backflow path F34, which connects the third EGR port 33 and the fourth EGR port 34 to each other.

Further, the cross-sectional area of the first constriction 371 is equal to the cross-sectional area of the fourth constriction 374. The cross-sectional area of the second constriction 372 is equal to the cross-sectional area of the third constriction 373. The cross-sectional area of the first backflow path constriction 37A is equal to the cross-sectional area of the second backflow path constriction 37B.

The operation of the present embodiment will be now described with reference to FIGS. 5 to 7.

Figure 5:
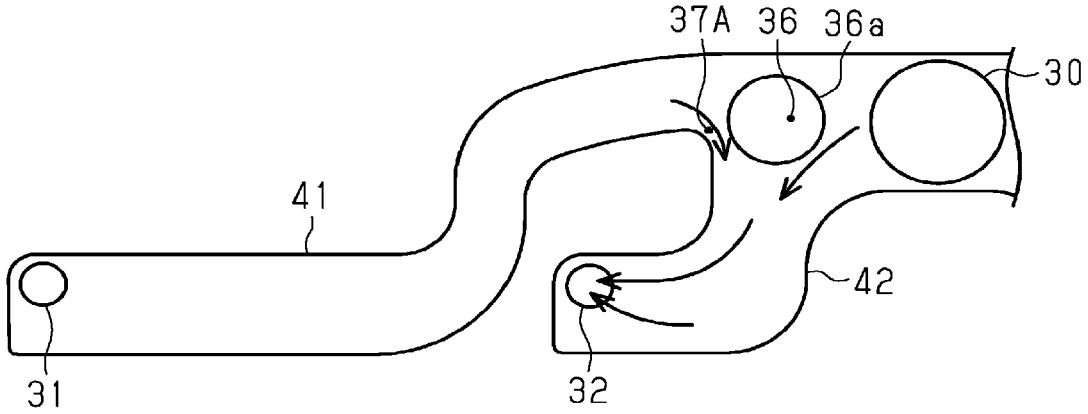
FIG. 5 is an operational diagram illustrating a flow of EGR gas in the EGR gas distributor during an intake stroke of the second cylinder.
Figure 6:
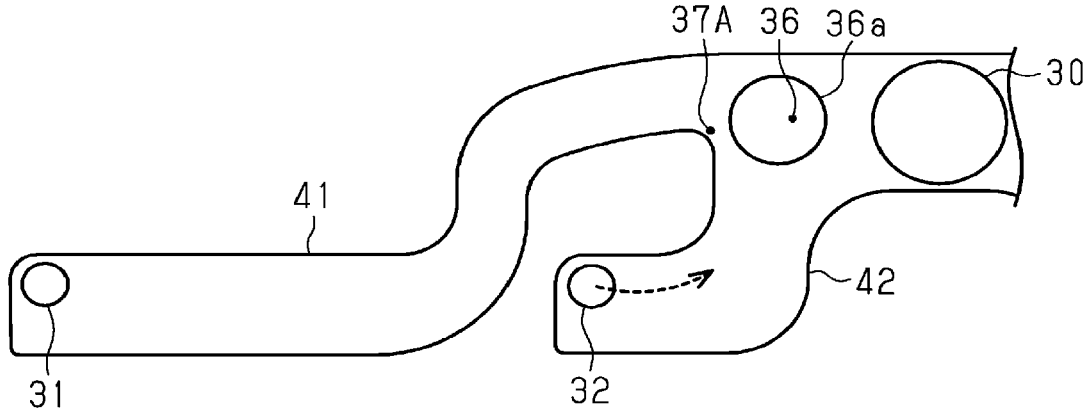
FIG. 6 is an operational diagram illustrating a case in which intake air flows into the EGR gas distributor through the second EGR port when the intake stroke of the second cylinder ends.

During the intake stroke of the second cylinder #2, EGR gas that has flowed into the first gas passage 41 from the inflow portion 30 flows into the second gas passage 42 from the connection site between the first gas passage 41 and the second gas passage 42 as indicated by the solid arrows in FIG. 5. At this time, the gas retained in the section between the first connection site and the first EGR port 31 in the first gas passage 41 also flows into the second gas passage 42 from the first connection site. In the second gas passage 42, EGR gas flows to the second EGR port 32 and flows out to the intake branch pipe 112 from the second EGR port 32. Accordingly, the EGR gas is introduced into the second cylinder #2. When the intake stroke of the second cylinder #2 ends, blowback of intake air in the intake branch pipe 112 causes the intake air to flow into the EGR gas distributor 23 from the intake branch pipe 112 through the second EGR port 32 as indicated by the dashed arrow in FIG. 6.

Figure 7:
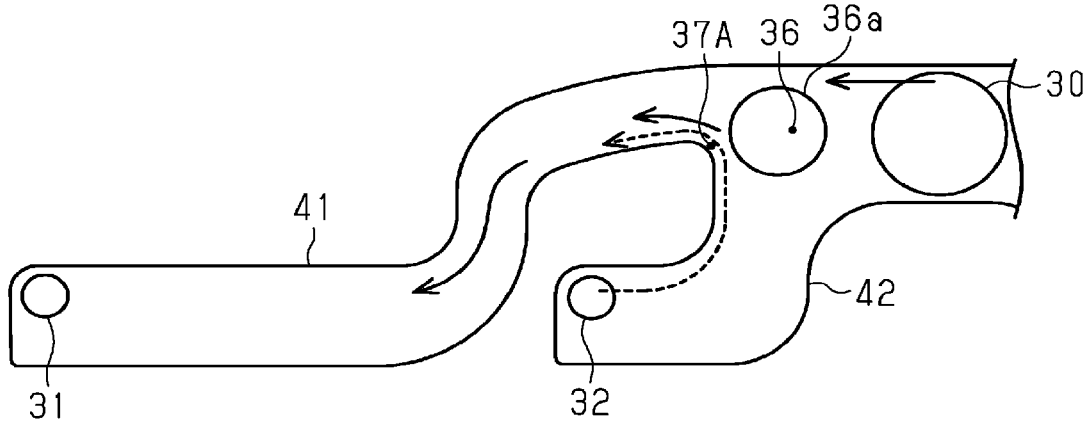
FIG. 7 is an operational diagram illustrating flows of EGR gas and intake air in the EGR gas distributor during an intake stroke of the first cylinder.

When the intake stroke of the first cylinder #1 starts, the EGR gas that has flowed into the first gas passage 41 from the inflow portion 30 flows toward the first EGR port 31 as indicated by the solid arrows in FIG. 7. The EGR gas retained in the second gas passage 42 also flows into the first gas passage 41 from the first connection site. In the first gas passage 41, the EGR gas flows to the first EGR port 31 and flows out to the intake branch pipe 111 from the first EGR port 31.

During the intake stroke of the first cylinder #1, the intake air that has flowed into the EGR gas distributor 23 through the second EGR port 32 flows backward in the second gas passage 42 as indicated by the dashed arrow in FIG. 7, and flows into the first gas passage 41 from the first connection site. The intake air that has flowed into the first gas passage 41 flows toward the first EGR port 31 together with the EGR gas.

In the present embodiment, the backflow path F12, which connects the first EGR port 31 and the second EGR port 32 to each other, is relatively long. Thus, the intake stroke of the first cylinder #1 ends before the intake air that flows into the first gas passage 41 from the first connection site and toward the first EGR port 31 reaches the first EGR port 31. This prevents the intake air that has flowed into the EGR gas distributor 23 through the second EGR port 32 from flowing out to the intake branch pipe 111 from the first EGR port 31.

When the intake stroke of the first cylinder #1 ends and outflow of gas from the first EGR port 31 is stopped, intake air is retained in the section between the first connection site and the first EGR port 31 in the first gas passage 41. However, the intake air retained in the first gas passage 41 flows into the second gas passage 42 through the first connection site together with EGR gas during the subsequent intake stroke of the second cylinder #2. The intake air then flows through the second gas passage 42 and flows out to the intake branch pipe 112 through the second EGR port 32.

During the intake stroke of the third cylinder #3, the EGR gas that has flowed into the fourth gas passage 44 from the inflow portion 30 flows into the third gas passage 43 from the second connection site. At this time, the gas retained in the section between the second connection site and the fourth EGR port 34 in the fourth gas passage 44 also flows into the third gas passage 43 from the second connection site. In the third gas passage 43, EGR gas flows to the third EGR port 33 and flows out to the intake branch pipe 113 of the intake manifold 11 through the third EGR port 33. Accordingly, the EGR gas is introduced into the third cylinder #3. When the intake stroke of the third cylinder #3 ends, blowback of intake air in the intake branch pipe 113 causes the intake air to flow into the EGR gas distributor 23 from the intake branch pipe 113 through the third EGR port 33.

When the intake stroke of the fourth cylinder #4 starts, the EGR gas that has flowed into the fourth gas passage 44 from the inflow portion 30 flows toward the fourth EGR port 34. The EGR gas retained in the third gas passage 43 also flows into the fourth gas passage 44 from the second connection site. In the fourth gas passage 44, the EGR gas flows to the fourth EGR port 34 and flows out to the intake branch pipe 114 through the fourth EGR port 34.

During the intake stroke of the fourth cylinder #4, the intake air that has flowed into the EGR gas distributor 23 through the third EGR port 33 flows backward in the third gas passage 43, and flows into the fourth gas passage 44 from the second connection site. The intake air that has flowed into the fourth gas passage 44 flows toward the fourth EGR port 34 together with EGR gas.

In the present embodiment, the backflow path F34, which connects the third EGR port 33 and the fourth EGR port 34 to each other, is long. Thus, the intake stroke of the fourth cylinder #4 ends before the intake air that flows into the fourth gas passage 44 from the second connection site and toward the fourth EGR port 34 reaches the fourth EGR port 34. This prevents the intake air that has flowed into the EGR gas distributor 23 through the third EGR port 33 from flowing out to the intake branch pipe 114 from the fourth EGR port 34.

When the intake stroke of the fourth cylinder #4 ends and outflow of gas from the fourth EGR port 34 is stopped, intake air is retained in the section between the second connection site and the fourth EGR port 34 in the fourth gas passage 44. However, the intake air retained in the fourth gas passage 44 flows into the third gas passage 43 through the second connection site together with EGR gas during the subsequent intake stroke of the third cylinder #3. The intake air then flows through the third gas passage 43 and out to the intake branch pipe 113 through the third EGR port 33.

The present embodiment has the following advantages.

(1) The backflow path F12, which connects the first EGR port 31 and the second EGR port 32 to each other, is set to be longer than both of the first path F1 and the second path F2. Thus, the intake stroke of the first cylinder #1 ends before the intake air that has flowed into the EGR gas distributor 23 through the second EGR port 32 at the end of the intake stroke of the second cylinder #2 reaches the first EGR port 31. Accordingly, the intake air is prevented from flowing out to the intake branch pipe 111 through the first EGR port 31. This limits the reduction in the amount of the EGR gas that flows out to the intake branch pipe 111 from the first EGR port 31 during the intake stroke of the first cylinder #1. This suppresses the deviation between the amount of the EGR gas introduced into the first cylinder #1 and the amount of the EGR gas introduced into the second cylinder #2.

(2) The backflow path F34, which connects the third EGR port 33 and the fourth EGR port 34 to each other, is set to be longer than both of the third path F3 and the fourth path F4. Thus, the intake stroke of the fourth cylinder #4 ends before the intake air that has flowed into the EGR gas distributor 23 through the third EGR port 33 at the end of the intake stroke of the third cylinder #3 reaches the fourth EGR port 34. Accordingly, the intake air is prevented from flowing out to the intake branch pipe 114 through the fourth EGR port 34. This limits the reduction in the amount of the EGR gas that flows out to the intake branch pipe 114 from the fourth EGR port 34 during the intake stroke of the fourth cylinder #4. This suppresses the deviation between the amount of the EGR gas introduced into the fourth cylinder #4 and the amount of the EGR gas introduced into the third cylinder #3.

(3) In the present embodiment, the first gas passage 41 and the second gas passage 42 have respective bent portions. Thus, the flow resistance of the backflow path F12, which extends over the interior of the second gas passage 42 and the interior of a section of the first gas passage 41 is high. This reduces the flow velocity of the intake air flowing from the second EGR port 32 toward the first EGR port 31. As a result, the intake air is unlikely to reach the first EGR port 31 during the intake stroke of the first cylinder #1. This effectively limits the outflow of the intake air to the intake branch pipe 111 from the first EGR port 31 during the intake stroke of the first cylinder #1.

The direction in which the first passageway 411 of the first gas passage 41 extends is different from the direction in which the fourth passageway 421 of the second gas passage 42 extends. This is considered to be the structure in which the first passageway 411 and the fourth passageway 421 are connected to each other via a bent portion. Accordingly, the number of the bent portions through which gas flows when flowing from the inflow portion 30 toward the first EGR port 31 and the number of the bent portions through which the gas flows when flowing from the inflow portion 30 toward the second EGR port 32 are both less than the number of the bent portions through which gas flows when flowing from the second EGR port 32 toward the first EGR port 31. This configuration prevents the flow of EGR gas from the inflow portion 30 to the first EGR port 31 or the second EGR port 32 from being hindered while hindering the flow of intake air from the second EGR port 32 toward the first EGR port 31 by providing multiple bent portions in the gas passages 41, 42.

(4) The first backflow path constriction 37A is provided in the vicinity of the connection site between the first gas passage 41 and the second gas passage 42. Thus, when intake air flows from the second EGR port 32 toward the first EGR port 31, the intake air flows through the first backflow path constriction 37A. That is, the backflow path F12 is configured to have the first backflow path constriction 37A. Since the backflow path F12 includes the first backflow path constriction 37A, the flow resistance of the gas flowing through the backflow path F12 is increased. This reduces the flow velocity of the intake air that flows through the backflow path F12 toward the first EGR port 31 during the intake stroke of the first cylinder #1. This effectively limits the outflow of the intake air to the intake branch pipe 111 from the first EGR port 31 during the intake stroke of the first cylinder #1.

The first path F1 has the first constriction 371, and the second path F2 has the second constriction 372. However, the cross-sectional area of the first constriction 371 and the cross-sectional area of the second constriction 372 are both larger than the cross-sectional area of the first backflow path constriction 37A. This prevents the flow of EGR gas from the inflow portion 30 to the first EGR port 31 or the second EGR port 32 from being hindered.

(5) The cross-sectional area of the first backflow path constriction 37A is larger than both of the cross-sectional area of the first EGR port 31 and the cross-sectional area of the second EGR port 32. Thus, even though the first backflow path constriction 37A is provided, the above-described embodiment is capable of reducing the amount of EGR gas that flows out to the intake branch pipe 112 from the second EGR port 32 during the intake stroke of the second cylinder #2 and reducing the amount of EGR gas that flows out to the intake branch pipe 111 from the first EGR port 31 during the intake stroke of the first cylinder #1.

(6) The third gas passage 43 and the fourth gas passage 44 have respective bent portions. Thus, the flow resistance of the backflow path F12, which extends over the interior of the third gas passage 43 and the interior of a section of the fourth gas passage 44 is high. This reduces the flow velocity of the intake air flowing from the third EGR port 33 toward the fourth EGR port 34. As a result, the intake air is unlikely to reach the fourth EGR port 34 during the intake stroke of the fourth cylinder #4. This effectively limits the outflow of the intake air to the intake branch pipe 114 from the fourth EGR port 34 during the intake stroke of the fourth cylinder #4.

The direction in which the eighth passageway 441 of the fourth gas passage 44 extends is different from the direction in which the sixth passageway 431 of the third gas passage 43 extends. This is considered to be the structure in which the eighth passageway 441 and the sixth passageway 431 are connected to each other via a bent portion. Accordingly, the number of the bent portions through which gas flows when flowing from the inflow portion 30 toward the third EGR port 33 and the number of the bent portions through which gas flows when flowing from the inflow portion 30 toward the fourth EGR port 34 are both less than the number of the bent portions through which gas flows when flowing from the third EGR port 33 toward the fourth EGR port 34. This configuration prevents the flow of EGR gas from the inflow portion 30 to the third EGR port 33 or the fourth EGR port 34 from being hindered while hindering the flow of intake air from the third EGR port 33 toward the fourth EGR port 34 by providing multiple bent portions in the gas passages 43, 44.

(7) The second backflow path constriction 37B is provided in the vicinity of the connection site between the third gas passage 43 and the fourth gas passage 44. Thus, when intake air flows from the third EGR port 33 toward the fourth EGR port 34, the intake air flows through the second backflow path constriction 37B. That is, the backflow path F34 is configured to have the second backflow path constriction 37B. Since the backflow path F34 includes the second backflow path constriction 37B, the flow resistance of the gas flowing through the backflow path F34 is increased. This reduces the flow velocity of the intake air that flows through the backflow path F34 toward the fourth EGR port 34 during the intake stroke of the fourth cylinder #4. This effectively limits the outflow of the intake air to the intake branch pipe 114 from the fourth EGR port 34 during the intake stroke of the fourth cylinder #4.

The third path F3 has the third constriction 373, and the fourth path F4 has the fourth constriction 374. However, the cross-sectional area of the third constriction 373 and the cross-sectional area of the fourth constriction 374 are both larger than the cross-sectional area of the second backflow path constriction 37B. This prevents the flow of EGR gas from the inflow portion 30 to the third EGR port 33 or the fourth EGR port 34 from being hindered.

(8) The cross-sectional area of the second backflow path constriction 37B is larger than both of the cross-sectional area of the third EGR port 33 and the cross-sectional area of the fourth EGR port 34. Thus, even though the second backflow path constriction 37B is provided, the configuration is capable of reducing the amount of EGR gas that flows out to the intake branch pipe 113 from the third EGR port 33 during the intake stroke of the third cylinder #3 and reducing the amount of EGR gas that flows out to the intake branch pipe 114 from the fourth EGR port 34 during the intake stroke of the fourth cylinder #4.

(9) Condensed water can be produced in the EGR gas distributor 23. Such condensed water flows out to the intake branch pipes 111 to 114 through the EGR ports 31 to 34. If acceleration is produced in the vehicle on which the internal combustion engine 10 is mounted when condensed water is retained in the EGR gas distributor 23, the condensed water flows in the EGR gas distributor 23 in a direction corresponding to the acceleration.

In the present embodiment, the direction in which the first passageway 411 of the first gas passage 41 extends is different from the direction in which the fourth passageway 421 of the second gas passage 42 extends. Thus, even if acceleration in the port arrangement direction Y is produced, the condensed water retained in the second gas passage 42 is prevented from flowing out of the second gas passage 42. Also, the condensed water retained between the first bent portion 41A and the first EGR port 31 in the first gas passage 41 is prevented from flowing into the other gas passages 42 to 44.

The direction in which the eighth passageway 441 of the fourth gas passage 44 extends is different from the direction in which the sixth passageway 431 of the third gas passage 43 extends. Thus, even if acceleration in the port arrangement direction Y is produced, the condensed water retained in the third gas passage 43 is prevented from flowing out of the third gas passage 43. Also, the condensed water retained between the fifth bent portion 44A and the fourth EGR port 34 in the fourth gas passage 44 is prevented from flowing into the other gas passages 41 to 43.

Therefore, when acceleration is produced in the vehicle, condensed water in the EGR gas distributor 23 is prevented from flowing out to any one of the intake branch pipes 111 to 114 in a concentrated manner. That is, the condensed water is prevented from flowing into any one of the cylinders #1 to #4 in a concentrated manner.

The above-described embodiment may be modified as follows. The above-described embodiment and the following modifications can be combined as long as the combined modifications remain technically consistent with each other.

If the backflow path F12, which connects the first EGR port 31 and the second EGR port 32 to each other, is longer than the first path F1 and the second path F2, the EGR gas distributor 23 may be configured without the first backflow path constriction 37A of the backflow path F12.

Likewise, if the backflow path F34, which connects the third EGR port 33 and the fourth EGR port 34 to each other, is longer than the third path F3 and the fourth path F4, the EGR gas distributor 23 may be configured without the second backflow path constriction 37B of the backflow path F34.

If the backflow path F12, which connects the first EGR port 31 and the second EGR port 32 to each other, is longer than the first path F1 and the second path F2, the EGR gas distributor 23 may be configured without the first bent portion 41A and/or the second bent portion 41B of the first gas passage 41. Further, the EGR gas distributor 23 may be configured without the third bent portion 42A of the second gas passage 42.

Likewise, if the backflow path F34, which connects the third EGR port 33 and the fourth EGR port 34 to each other, is longer than the third path F3 and the fourth path F4, the EGR gas distributor 23 may be configured without the fifth bent portion 44A and/or the sixth bent portion 44B of the fourth gas passage 44. Further, the EGR gas distributor 23 may be configured without the fourth bent portion 43A of the third gas passage 43.

If the backflow path F12, which connects the first EGR port 31 and the second EGR port 32 to each other, is longer than the first path F1 and the second path F2, the first connection site, which connects the first gas passage 41 and the second gas passage 42 to each other, may be located at a position other than between the second EGR port 32 and the inflow portion 30 in the port arrangement direction Y.

Likewise, if the backflow path F34, which connects the third EGR port 33 and the fourth EGR port 34 to each other, is longer than the third path F3 and the fourth path F4, the second connection site, which connects the third gas passage 43 and the fourth gas passage 44 to each other, may be located at a position other than between the third EGR port 33 and the inflow portion 30 in the port arrangement direction Y.

The EGR gas distributor 23 may be employed in an internal combustion engine in which intake strokes start in order of the first cylinder #1, the third cylinder #2, the fourth cylinder #4, and the second cylinder #3.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An EGR gas distributor configured to be employed in an internal combustion engine that includes a first cylinder, a second cylinder, a third cylinder, and a fourth cylinder arranged in order in a cylinder arrangement direction, wherein a starting point in time of an intake stroke of the first cylinder and a starting point in time of an intake stroke of the second cylinder are temporally adjacent to each other, the EGR gas distributor being configured to be connected to an intake manifold of the internal combustion engine, the EGR gas distributor comprising:

an inflow portion that is an inlet into which EGR gas that has passed through an EGR valve flows;

a first EGR port connected to a section of the intake manifold in which intake air introduced into the first cylinder flows;

a second EGR port connected to a section of the intake manifold in which intake air introduced into the second cylinder flows;

a first gas passage that connects the inflow portion and the first EGR port to each other; and a second gas passage that connects the first gas passage and the second EGR port to each other, wherein a shortest path between the first EGR port and the second EGR port is longer than both of a shortest path between the inflow portion and the first EGR port and a shortest path between the inflow portion and the second EGR port, and wherein a bent portion that changes a flowing direction of gas is provided in each of the first gas passage and the second gas passage such that the first gas passage and the second gas passage extend in a same direction with each other.

2. The EGR gas distributor according to claim 1, wherein a constriction is provided in the shortest path between the first EGR port and the second EGR port.

3. The EGR gas distributor according to claim 1, comprising:

a third EGR port connected to a section of the intake manifold in which intake air introduced into the third cylinder flows;

a fourth EGR port connected to a section of the intake manifold in which intake air introduced into the fourth cylinder flows;

a fourth gas passage that connects the inflow portion and the fourth EGR port to each other; and a third gas passage that connects the fourth gas passage and the third EGR port to each other, wherein a direction in which the first to fourth EGR ports are arranged is referred to as a port arrangement direction, the first to fourth EGR ports are arranged in the port arrangement direction in order of the first EGR port, the second EGR port, the third EGR port, and the fourth EGR port, the inflow portion is disposed between the second EGR port and the third EGR port in the port arrangement direction, and a shortest path between the third EGR port and the fourth EGR port is longer than both of a shortest path between the inflow portion and the third EGR port and a shortest path between the inflow portion and the fourth EGR port.

4. The EGR gas distributor according to claim 3, wherein a connection site between the first gas passage and the second gas passage is located between the second EGR port and the inflow portion in the port arrangement direction.

5. The EGR gas distributor according to claim 3, wherein a connection site between the third gas passage and the fourth gas passage is located between the third EGR port and the inflow portion in the port arrangement direction.

6. The EGR gas distributor according to claim 1, wherein the inflow portion is a port that is configured to be connected to an EGR passage.

* * * * *